US006938686B2

(12) United States Patent
Wu et al.

(10) Patent No.: US 6,938,686 B2
(45) Date of Patent: Sep. 6, 2005

(54) LATERAL PLATE SURFACE COOLED HEAT EXCHANGER

(75) Inventors: Alan Ka-Ming Wu, Kitchener (CA); Michael A. Martin, Oakville (CA)

(73) Assignee: Dana Canada Corporation, Oakville (CA)

( * ) Notice: Subject to any disclaimer, the term of this patent is extended or adjusted under 35 U.S.C. 154(b) by 0 days.

(21) Appl. No.: 10/692,165

(22) Filed: Oct. 23, 2003

(65) Prior Publication Data

US 2004/0188078 A1 Sep. 30, 2004

(30) Foreign Application Priority Data

Mar. 24, 2003 (CA) ..... 2423193

(51) Int. Cl.[7] ..... F28D 1/03
(52) U.S. Cl. ..... 165/148; 165/183
(58) Field of Search ..... 165/67, 183, 148

(56) References Cited

U.S. PATENT DOCUMENTS

| | | | | |
|---|---|---|---|---|
| 3,810,509 A | * | 5/1974 | Kun | 165/148 |
| 3,818,984 A | * | 6/1974 | Nakamura et al. | 165/166 |
| 4,162,703 A | | 7/1979 | Bosaeus | |
| 4,219,079 A | | 8/1980 | Sumitomo | |
| 4,235,285 A | | 11/1980 | Johnson et al. | |
| 4,253,520 A | | 3/1981 | Friedericy et al. | |
| 4,448,241 A | | 5/1984 | Andres et al. | |
| 4,805,693 A | | 2/1989 | Flessate | |
| 4,932,469 A | | 6/1990 | Beatenbough | |
| 5,025,641 A | * | 6/1991 | Broadhurst | 62/347 |
| 5,209,285 A | | 5/1993 | Joshi | |
| 5,369,883 A | | 12/1994 | So et al. | |
| 5,462,113 A | | 10/1995 | Wand | |
| 5,689,881 A | | 11/1997 | Kato | |
| 5,692,559 A | | 12/1997 | Cheong | |
| 5,799,727 A | | 9/1998 | Liu | |
| 6,035,928 A | | 3/2000 | Ruppel et al. | |
| 6,109,217 A | | 8/2000 | Hedlund et al. | |
| 6,164,371 A | | 12/2000 | Bertilsson | |
| 6,247,528 B1 | | 6/2001 | Blomgren et al. | |
| 6,305,466 B1 | | 10/2001 | Andersson et al. | |

FOREIGN PATENT DOCUMENTS

| | | |
|---|---|---|
| EP | 0 384 316 | 8/1990 |
| EP | 1 136 667 A2 | 9/2001 |
| EP | 1 136 667 A3 | 4/2004 |
| GB | 1 424 689 | 2/1976 |

OTHER PUBLICATIONS

Martin Fiebig and Yuwen Chen: Heat Transfer Enhancement by Wing–Type Longitudinal Vortex Generations and Their Application to Finned Oval Tube Heat Exchanger Element, from P. 79–105 of S. Kakac et al, Heat Transfer Enhancement of Heat Exchangers, Kluwer Academic Publsihers, 1999.

U.S. Appl No. 10/453,361, filed on Jun. 3, 2003, entitled "Lateral Plate Finned Heat Exchanger" .

* cited by examiner

*Primary Examiner*—Teresa J. Walberg
(74) *Attorney, Agent, or Firm*—Ridout & Maybee LLP

(57) ABSTRACT

A surface cooled heat exchanger including a stack of elongate plate pairs, each plate pair including first and second plates having elongate central portions surrounded by sealably joined edge portions with a fluid passage defined between the central portions; each plate pair having spaced apart inlet and outlet openings that are connected together for the flow of fluid through the fluid passages; each plate pair having an exposed fin plate extending peripherally outward from the joined edge portions along a length of the plate pair. Each fin plate may have a varying edge profile along an outwardly extending edge thereof.

24 Claims, 9 Drawing Sheets

LATERAL PLATE SURFACE COOLED HEAT EXCHANGER

BACKGROUND OF THE INVENTION

The present invention relates to surface cooled heat exchangers used for cooling fluid.

Surface cooled heat exchangers are often used in applications where the height clearance for a heat exchanger is quite low, for example, slush box engine coolant coolers in snowmobiles, and under-body mounted fuel coolers in automotive applications. One style of known surface cooled heat exchangers are extrusion formed devices that include fins integrally extruded with top and bottom walls that are connected along opposite sides to define a cavity that is welded shut at opposite ends after extrusion to provide a fluid cooling container. An example of such a heat exchanger for use as a rear cooler on a snowmobile can be seen in U.S. Pat. No. 6,109,217 issued Aug. 29, 2000. In extrusion formed coolers, the extrusion process makes it difficult to include fluid circuiting baffles or turbulizers within the cavity.

Known low profile surface cooled heat exchangers can be heavy and can be relatively expensive to manufacture. Thus, there is a need for a surface cooled heat exchanger that is relatively light-weight and relatively cost efficient to manufacture. Also desired is a surface cooled heat exchanger that can be manufactured in a range of sizes with little tooling changes, and in which flow circuiting can be easily incorporated.

SUMMARY OF THE INVENTION

According to one aspect of the invention, there is provided a surface cooled heat exchanger that includes a stack of elongate plate pairs, each plate pair including first and second plates having elongate central portions surrounded by sealably joined edge portions with a fluid passage defined between the central portions; each plate pair having spaced art inlet and outlet openings that are connected together for the flow of fluid through the fluid passages. Each plate pair has an exposed fin plate extending peripherally outward from the joined edge portions along a length of the plate pair. The plate pairs include two end plate pairs and intermediate plate pairs arranged between the end plate pairs. Each end plate pair abuts on one side thereof wit a respective one of the intermediate plate pairs. The elongate central portion of the first elate of each intermediate plate pair abuts the elongate central portion of the second plate of an adjacent one of the plate pairs.

According to another aspect of the invention, there is provide a cooler for cooling snowmobile engine coolant. The cooler includes a stack of elongate late pairs, each plate pair including first and second plates that are joined together to define elongate sealed internal passage for the engine coolant having spaced apart inlet and outlet a openings. The first and second plates have elongate central portions surrounded by sealably joined edge portions. The internal passage is formed between the central portions of each plate pair and extends substantially from a first end to a second end of the respective late air. The plate pairs include two end plate pairs and intermediate plate pairs arranged between the end plate pairs. Each end plate pair abuts on one side thereof with a respective one of the intermediate plate pairs. The elongate central portion of the first plate of each intermediate plate pair abuts the elongate central portion of the second plate of an adjacent one of the plate pairs substantially from the first end to the second end thereof. Each plate pair includes an enlarged exposed fin plate portion located adjacent a substantial length of the internal passage for receiving materials flung by a drive track of the snowmobile. Mounting bracket means are connected to the stack of plate pairs for securing the stack to the snowmobile.

BRIEF DESCRIPTION OF THE DRAWINGS

Preferred embodiments of the present invention will be described, by way of example with reference to the following drawings.

DESCRIPTION OF THE PREFERRED EMBODIMENTS

Figure 1:
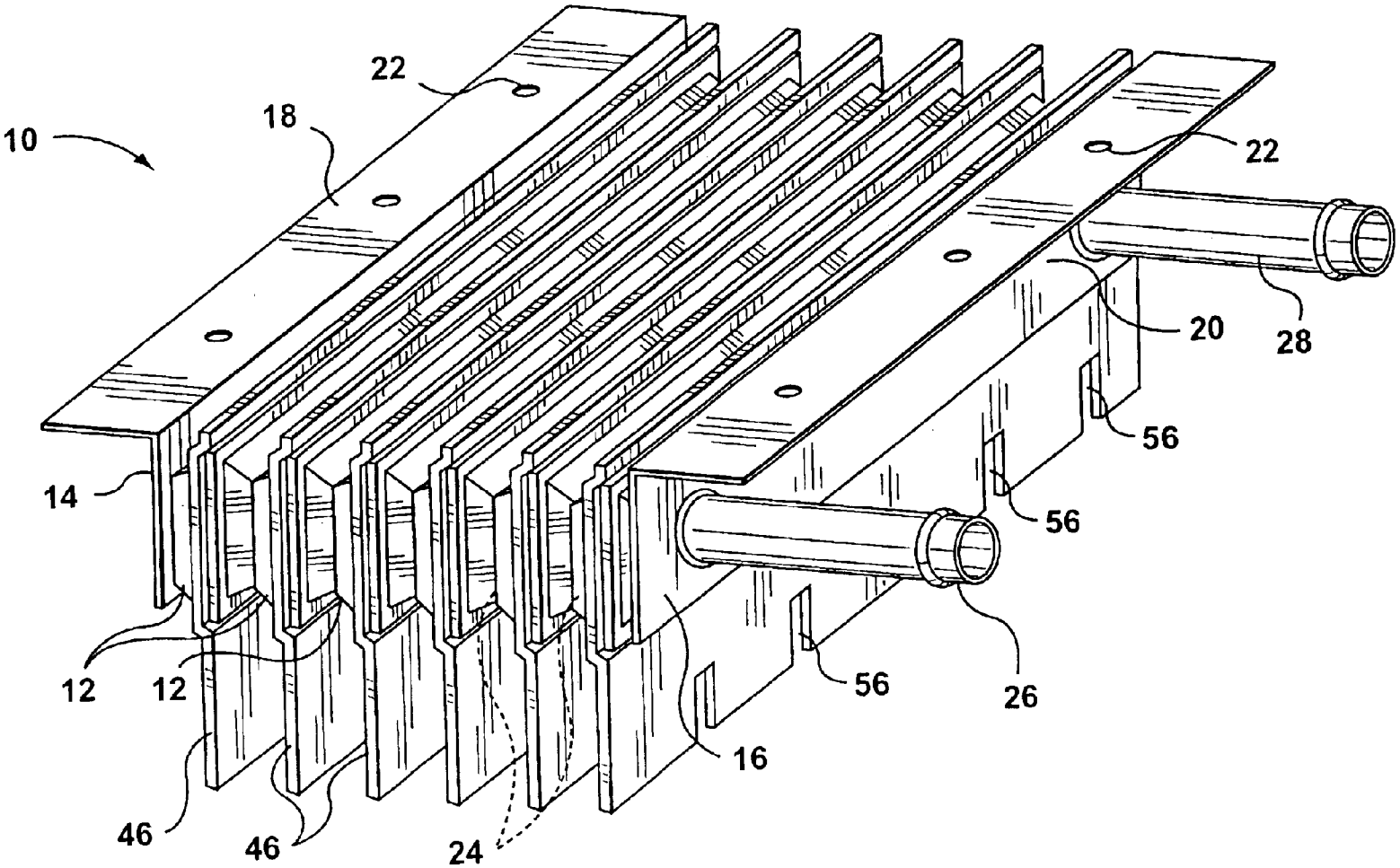
FIG. 1 is a perspective view of a plate pair heat exchanger according to embodiments of the invention.

Referring to FIG. 1, a heat exchanger according to preferred embodiments of the invention is indicated generally by reference numeral 10. Heat exchanger 10 is formed from a plurality of parallel plate pairs 12, which are sandwiched between first and second end support plates 14, 16. The end support plates 14, 16, as shown, are L-shaped with horizontal mounting flanges 18, 20, each of which has a plurality of mounting holes 22 formed therethrough for mounting the heat exchanger 10 in a desired location. First and second end support plates 14, 16 may be omitted, altered or replaced with other suitable arrangements for mounting heat exchanger 10.

Figure 2:
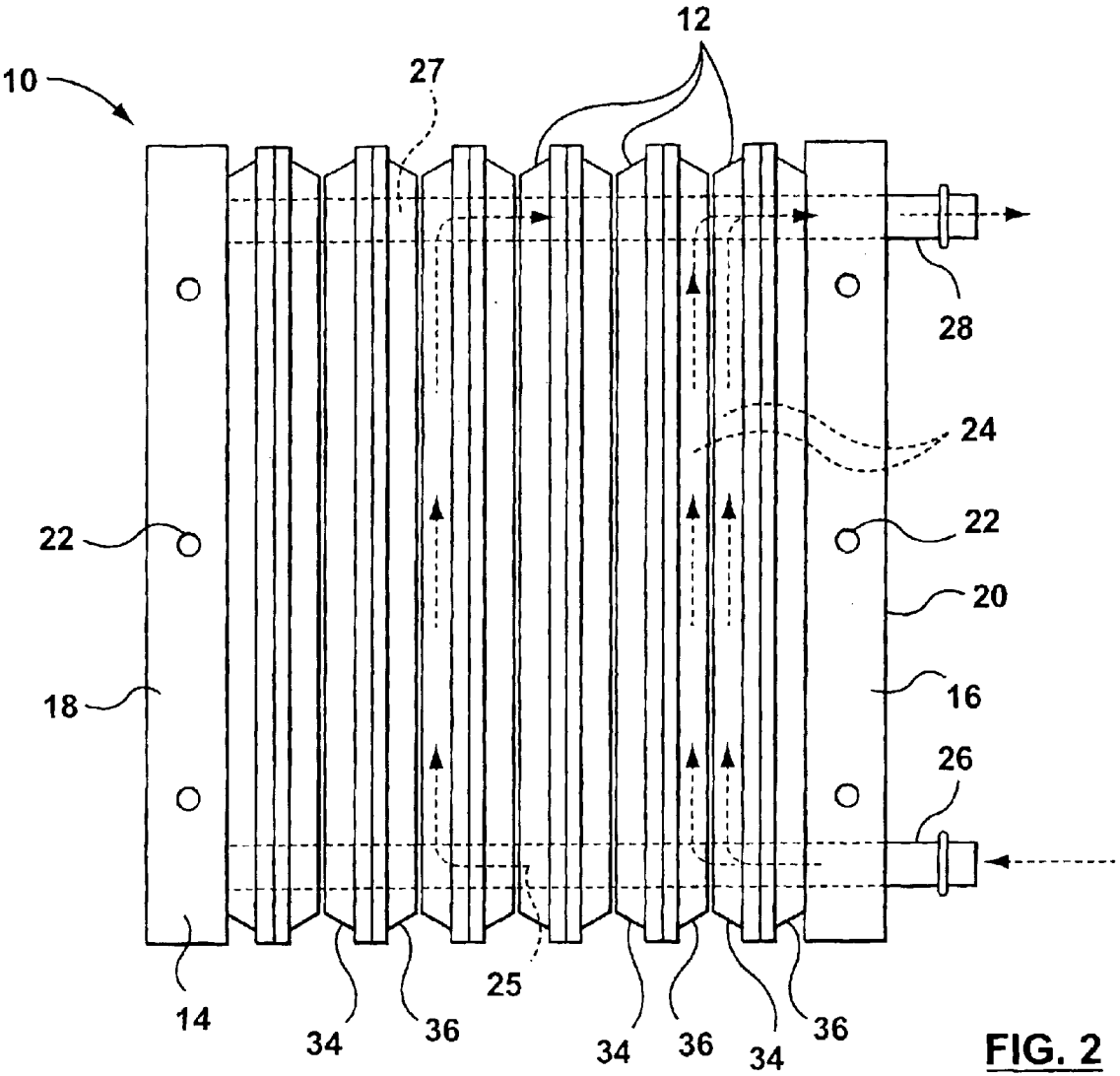
FIG. 2 is a top plan view if the heat exchanger of FIG. 1.

Referring to FIG. 2, plate pairs 12 each define an internal elongate fluid passage 24 that extends from substantially a first end to a second end of the plate pair 12. Each plate pair 12 includes inlet and outlet openings at opposite ends thereof in flow communication with the fluid passage 24, with the inlet openings being aligned across the width of the heat exchanger to form an inlet manifold (shown in phantom in FIG. 2, and indicated by reference numeral 25) in communication with an inlet fitting 26, and the outlet openings being aligned to form an outlet manifold (shown in phantom in FIG. 2, and indicated by reference numeral 27) in flow communication with an outlet fitting 28.

Figure 3:
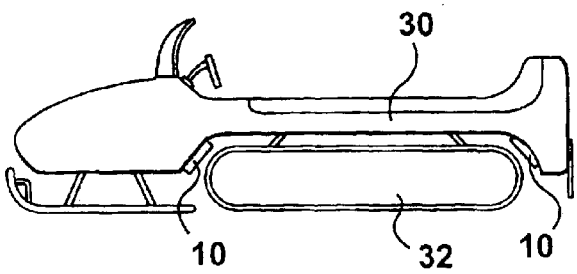
FIG. 3 is a diagrammatic illustration of a snowmobile having a heat exchanger according to the present invention.

In one preferred embodiment, the heat exchanger 10 is used as a snowmobile cooler for cooling the liquid coolant used to cool the snowmobile engine. With reference to FIG. 3, in such a configuration, one or more heat exchangers 10 are mounted between the chassis and drive track 32 of a snowmobile 30. Engine coolant entering through inlet fitting 26 and exiting through outlet fitting 28 is cooled by slush, snow, ice, and water that is flung from the drive track 32 onto the heat exchanger 10. Embodiments of the heat exchanger may also be used in other applications, such as an underbody fuel cooler for a wheeled vehicle, for example.

Figure 4:
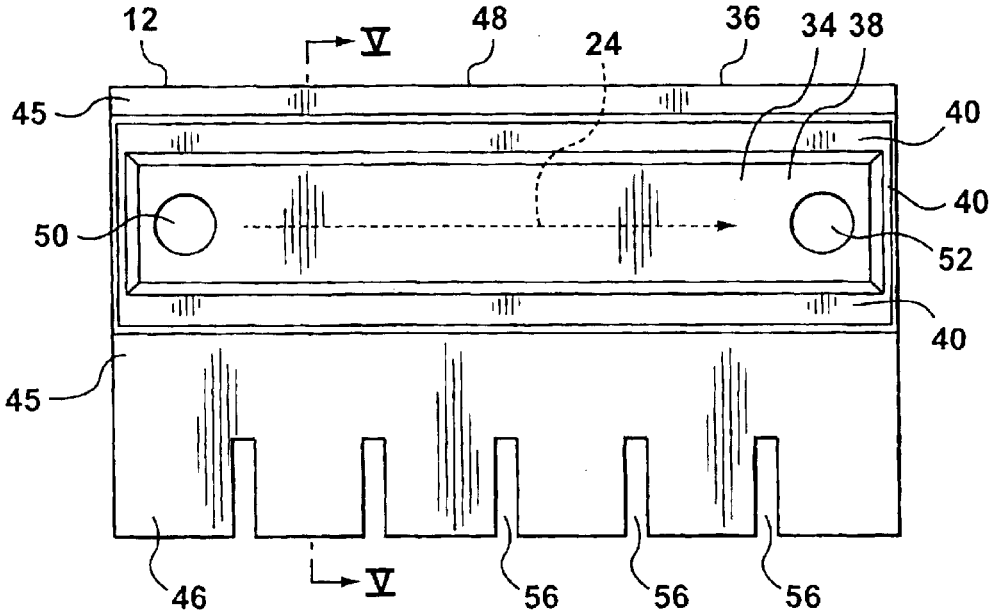
FIG. 4 is a side elevation of a single plate pair of the heat exchanger of FIG. 1.

With reference to FIGS. 4 and 5, the plate pairs 12 will now be described in greater detail. Each plate pair 12 is made up of a first plate 34 and a second plate 36. The first plate 34 includes an elongate central planar portion 38 that is surrounded by a peripheral edge portion 40. The second plate 36 includes an elongate central planar portion 42, which is also surrounded by an edge portion 44, which in turn is surrounded by an integral, peripherally extending flange 45. The peripherally extending flange 45 includes a substantially planar, fin plate portion 46 that extends outward from one elongate side of the edge portion 44, providing an enlarged exposed air-side heat exchange surface. According to embodiments of the present invention, edge enhancements, which may be slots 56, are provided intermittently along the fin plate 46, providing the fin plate with a varying profile along its length. Such edge enhancements may augment heat transfer or external fluid draining. Although rectangular, open-ended slots 56 are shown in FIGS. 1 and 4, slots 56 could take other shapes, and may be set in from the lower edge such that they are closed-ended.

First and second plates 34 and 36 are placed together and sealably connected about edge portions 40, 44 to form plate pair 12 in which the fluid passage 24 is defined between spaced apart planar central portions 38, 42. Openings 50, 52 that are in communication with fluid passage 24 are provided through the end areas of planar central portions 38, 42 (Such openings may be omitted from the final plate 46 in the stack). When plate pairs 12 are stacked together to form heat exchanger 10, all of the openings 50 are in registration and communicate with inlet fitting 26 (thereby forming inlet manifold 25), and all of the openings 52 are in registration and communicate with outlet fitting 28 (thereby forming outlet manifold 27). In such a configuration all of the fluid passing internally through the heat exchanger fluid passages 24 flows in parallel through plate pairs 12. However, it will be appreciated that some of the openings 50, 52 in selected plates could be omitted or otherwise blocked so that fluid could be made to flow in series through each of the plate pairs 12, or in some series/parallel multi-pass combination. In a multi-pass configuration, the locations of at least one of the inlet and outlet fittings 26,28 may have to be varied from that shown in FIGS. 1 and 2—for example, the outlet fitting may be at the same end, but at the opposite side of heat exchanger than the inlet fitting. The locations and types of inlet and outlet fittings shown in the Figures are exemplary only and not relevant to the broader aspects of the invention.

Figure 5A:
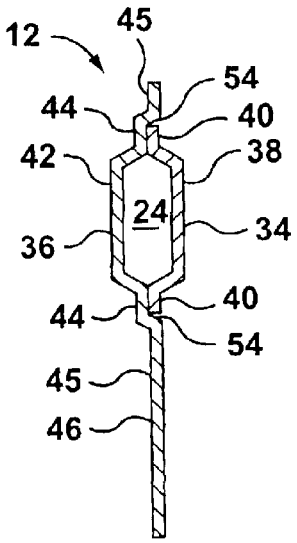
FIG. 5A is a sectional view of the plate pair, taken along lines V—V of FIG. 4.
Figure 5B:
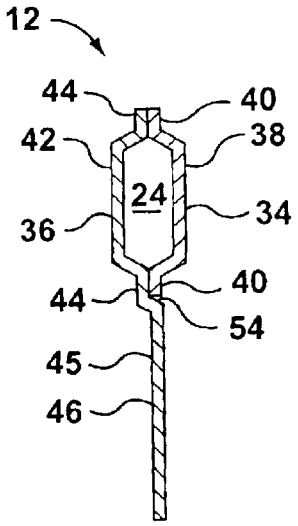
FIG. 5B is a sectional view of an alternative embodiment of the plate pair.

With reference to FIG. 5A, in a preferred embodiment, a lateral locating wall 54 integrally connects the edge portion 44 of plate 36 with the flange portion 45 thereof, forming a pocket in plate 36 within which the edge portion 40 of first plate 34 is nested. Such a feature provides a self-locating and self aligning function during assembly of the plate pairs 12. FIG. 5B shows a sectional view of an alternative embodiment in which the locating wall 54 and flange portion 45 are only provided along with fin side of the plate pair 12. In some embodiments, the step wall 54 may be omitted completely.

Referring to FIGS. 1 and 2, in the illustrated embodiment, the heat exchanger 10 includes two end plate pairs 12, and a plurality of intermediate plate pairs 12 all of which are arranged parallel to each other. The end plate pairs each abut on one side thereof with a respective intermediate plate pair, and the intermediate pairs are each sandwiched on both sides of other plate pairs. For each of the intermediate plate pairs, the planar central portion 38 of the first plate 34 of one plate pair 12 abuts against the planar central portion 42 of the second plate 36 of an adjacent plate pair 12. Fin plate portions 46 are spaced apart from each other such that ice, snow, air, slush, water and other materials can be thrown up on and in between the fin plate portions 46 by snowmobile drive track 32.

Figures 6A, 6B, 6C, 6D:
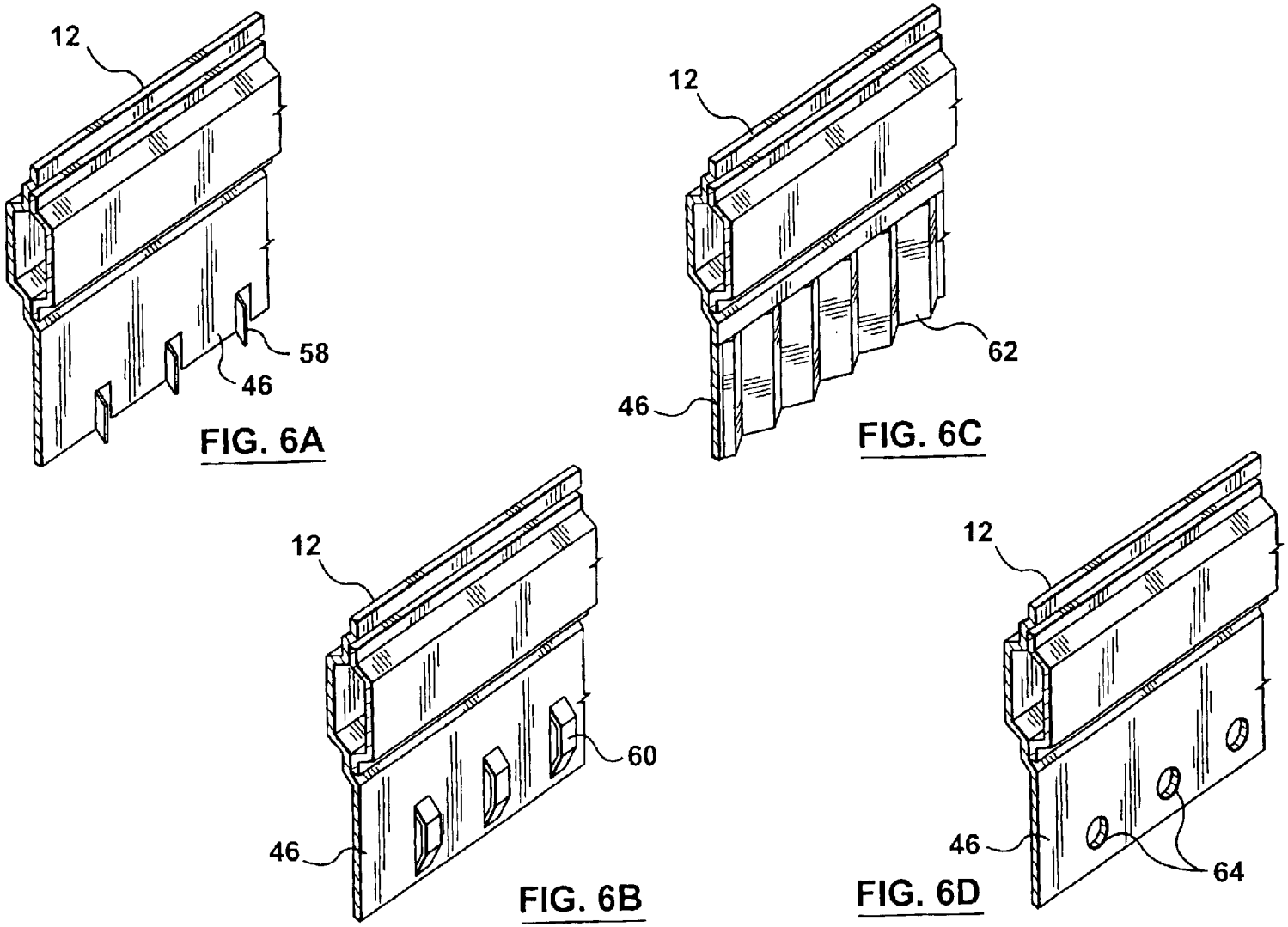
FIGS. 6A–6D are partial perspective views of plate pairs of the heat exchanger showing alternative forms of edge enhancements.

The enhancements that are provided along the lower portion of fin plate portion 46 could include further enhancements in addition to or in place of slots 56. For example, FIGS. 6A–6D show examples of plate pairs 12 in which different types of enhancements are provided on fin plate portion 46. In the fin plate 12 of FIG. 6A, louvered slots 58 are provided along the bottom edge portion of fin plate portion 46. In FIG. 6B, expanded convolutions 60 are provided along the length of fin plate portion 46 at spaced intervals. In FIG. 6C, the fin plate portion 46 is rippled or corrugated along its length. In FIG. 6D, stamped openings 64 are provided along the length of fin plate portion 46. Although the stamped openings 64 are shown as circular, they could be other shapes for example, rectangular. Different types of enhancements could be used along the same fin plate portion—for example, slots 56, louvered slots 58, convolutions 60 and circular openings 64 could each be located at spaced intervals along the same fin plate portion 46. Additionally, the edge enhancements used on the different plate pairs throughout the heat exchanger stack could be varied from plate pair to plate pair. In addition to providing improved heat transfer in some applications, the edge enhancements may also increase the strength of the fin plate portions 46 of the plate pairs 12. The size of the fin plate portion and the edge enhancement applied thereto can be chosen to give predetermined or desired heat exchange and strength characteristics to the heat exchanger.

Figure 7:
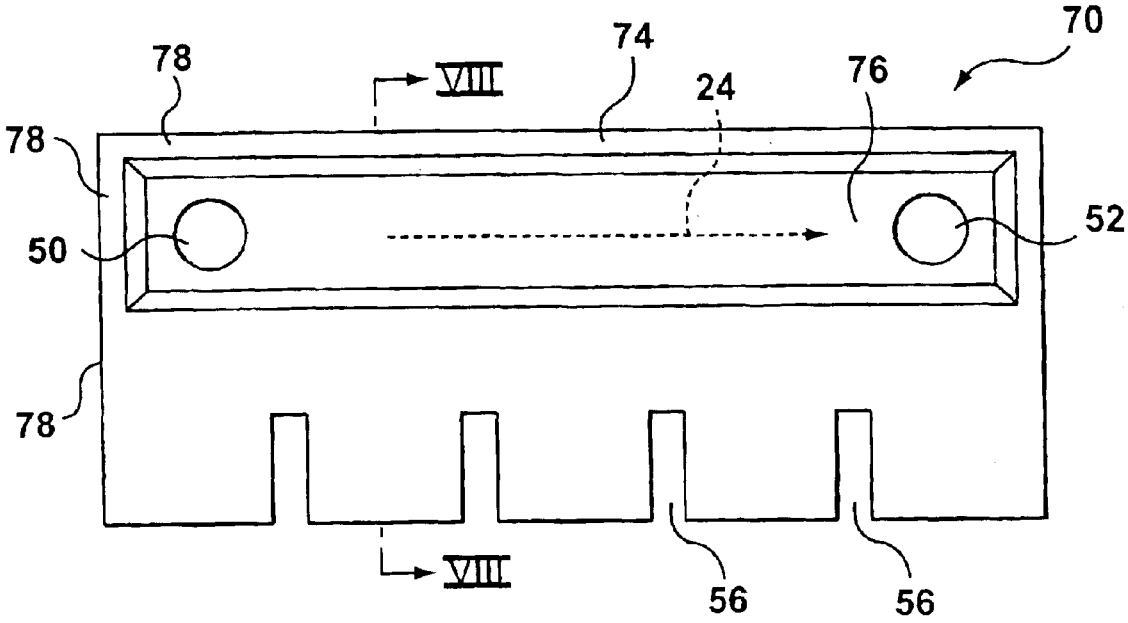
FIG. 7 is a side elevation of a single plate pair according to a further embodiment of the invention.
Figure 8:
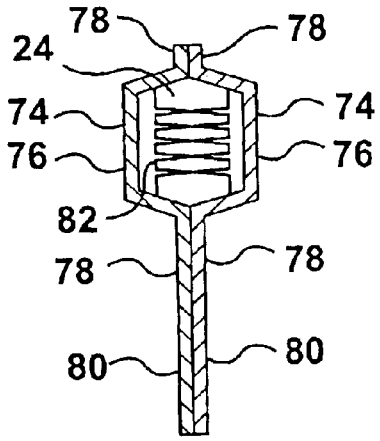
FIG. 8 is a sectional view of the plate pair of FIG. 7, taken along lines VIII—VIII of FIG. 7.

In some embodiments, the plate pairs would be formed from identical or substantially identical plates. By way of example, FIGS. 7 and 8 show an embodiment of a plate pair 70 that could be used in heat exchanger 10 in place of plate pair 12. The plate pair 70 is formed from two substantially identical plates 74. Each plate 74 includes an elongate central planar portion 76 that is surrounded by a peripheral edge portion 78. The part of peripheral edge portion 78 that is along an elongate side of the central planar portion 76 is enlarged to provide a lower fin plate 80. The plates 74 are sealably joined about peripheral edge portions 78, with central planar portions 76 being spaced apart and defining flow passage 24 therebetween. The planar fin plates 80 of each of the plates 74 have parallel abutting surfaces, and may have edge enhancements such as slots 56 provided along their respective lengths. Alternative edge enhancements such as those described above in respect of FIGS. 6A–6D could also be used.

Various flow augmentation devices that are known in the art o plate pair type heat exchanger could be used in the flow passages of the plate pairs of the present invention to improve heat transfer and strengthen the heat exchanger structure. By way of example, an elongate turbulizer 82 (FIG. 8) including rows of expanded convolutions could extend the length of flow passage 24. Alternatively, ribs such as those shown in U.S. Pat. No. 5,692,559 issued Dec. 2, 1997 could be provided along the walls that define the fi w passage 24. Dimples along the flow passage 24 walls could also be used to augment flow.

Figure 9:
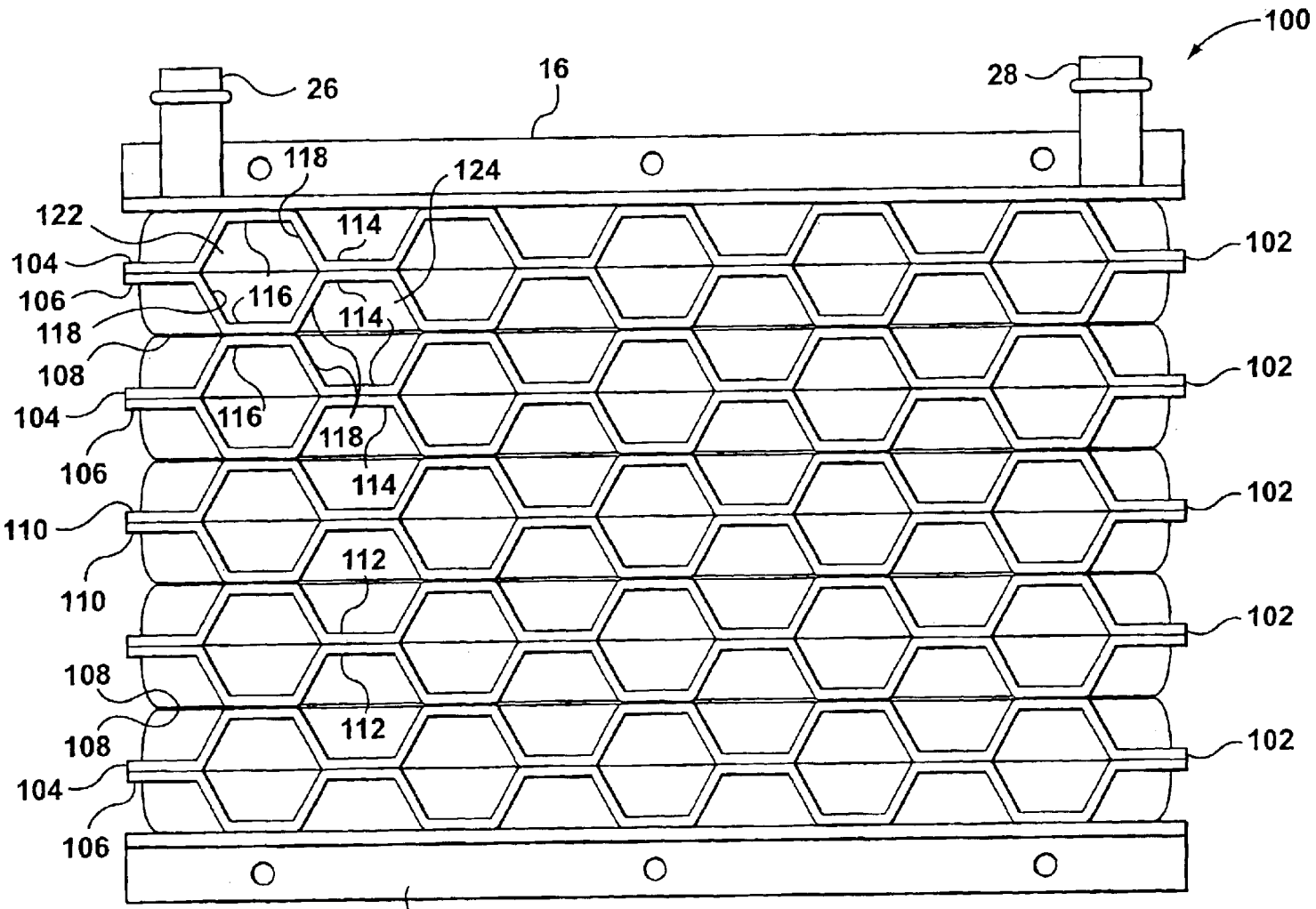
FIG. 9 is a bottom view of a heat exchanger according to another embodiment of the invention.
Figure 10:
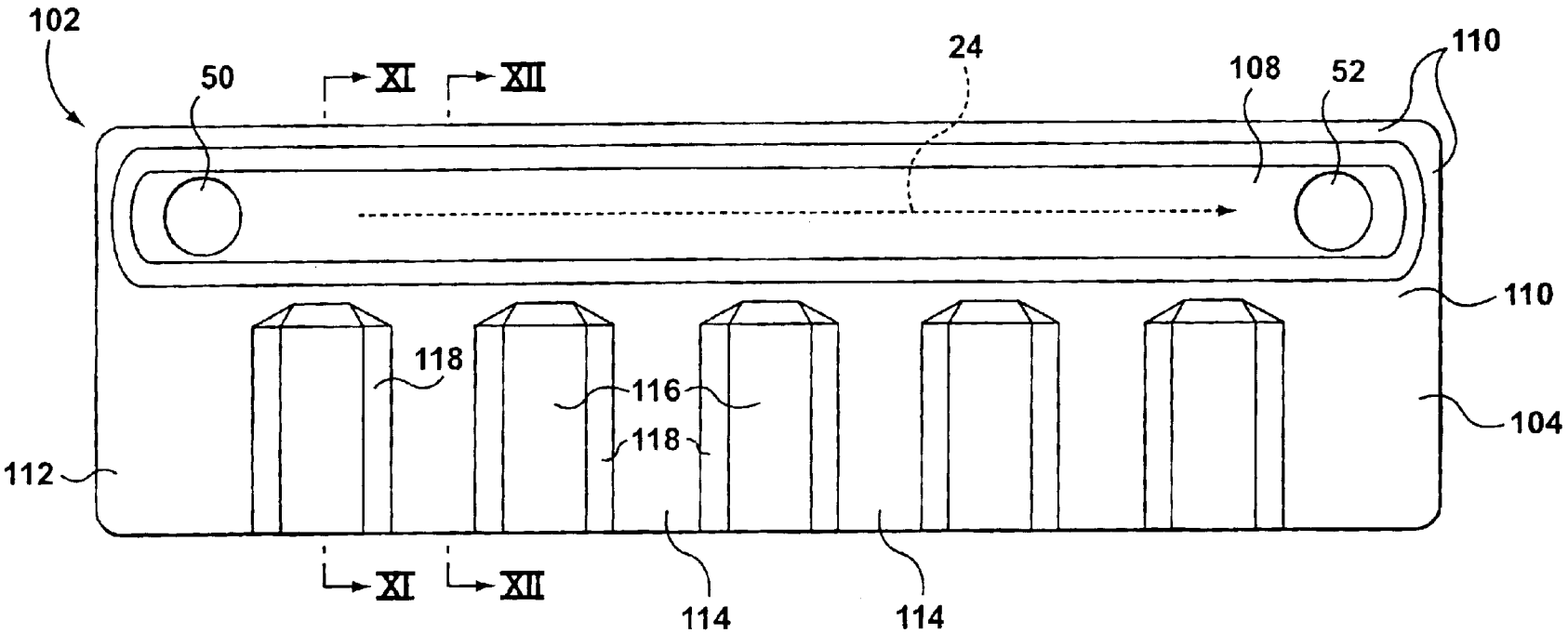
FIG. 10 is a side elevation of a plate pair of the heat exchanger of FIG. 9.
Figure 11:
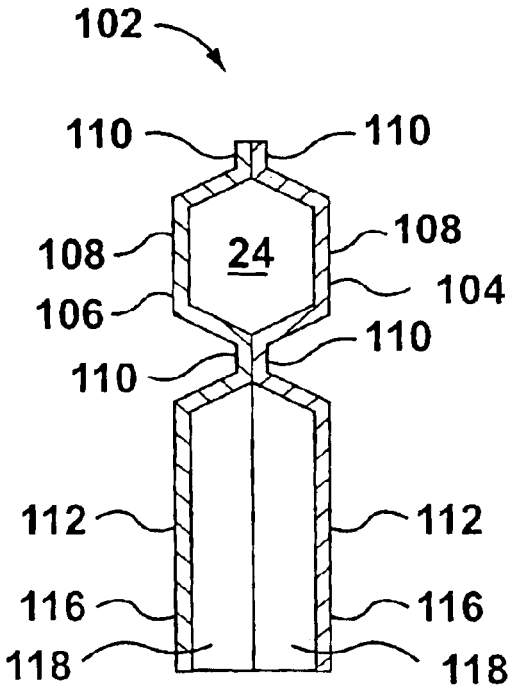
FIG. 11 is a sectional view of the plate pair, taken along line XI—XI of FIG. 10.
Figure 12:
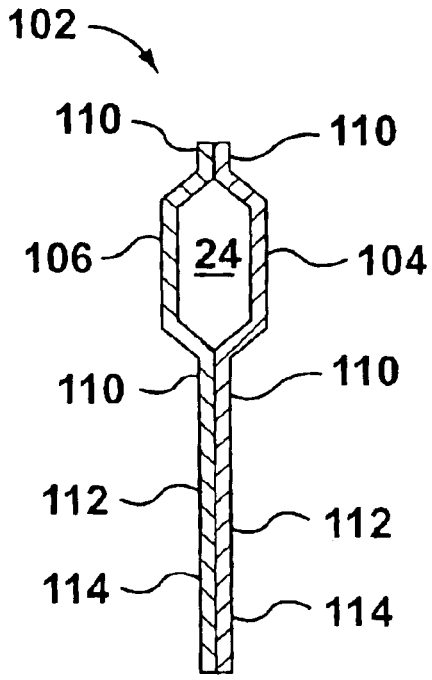
FIG. 12 is a further sectional view, taken along the line XII—XII of FIG. 10.

With reference to FIGS. 9 through 12, another embodiment of a heat exchanger, indicated generally by reference 100 in FIG. 9, is shown. FIG. 9 shows a bottom view of heat exchanger 100, which is similar in construction and operation to heat exchanger 10, except for the differences in plate pair configuration discussed as follows. The heat exchanger 100 is formed from a stack of plate pairs 102, which are sandwiched between end brackets 14, 16. Each plate pair 102 is formed from two substantially identical plates 104, 106, each of which has an elongate, substantially planar central portion 108 that is surrounded by an edge portion 110. The edge portions 110 of the plates 104, 106 are sealably joined together, with central planar portions 108 being spaced apart and defining an elongate internal fluid passage 24 that extends from an inlet opening 50 to an outlet opening 52. An integral fin plate 112 extends downwardly from the bottom of edge portion 110 of each plate 104,106. The fin plate 112 has a series of half-hex patterns stamped along its length, such that when the fin plates 112 are assembled into plate pairs 102 and the plate pairs are stacked to form the heat exchanger core, the fin plates 112 form a hexagonal honeycomb-like pattern as best seen in the bottom view of FIG. 9.

In particular, each fin plate 112 includes planar inner wall portions 114 that are interspaced by outwardly offset outer wall portions 116. The outer wall portions 116 (see FIG. 9) are each joined at opposite, upwardly extending side edges to inner wall portions 114 by angled connecting wall portions 118. In one embodiment, outer wall portions 116 have an outer surface that is in the same plane as an outer surface of the central planar portion 108 such that when the plate pairs 102 are stacked together, the central planar portions 108 of the adjacent plates of adjacent plate pairs abut against each other, and the outer wall portions 116 of the adjacent plates of adjacent plate pairs also abut against each other. As can be seen in FIG. 9, internal plate pair hexagonal cells 122 are defined by the outer and connecting walls 116 and 118 of the plates 104 and 106 of a plate pair 102, and intra-plate pair hexagonal cells 124 are formed by the inner and connecting walls 114 and 118 of the plate 106 from one plate pair 102 and the inner and connecting walls 114 and 118 of the plate 104 from an abutting plate pair 102. Such a configuration provides structural strength and a relatively large external air side surface area for heat transfer. Although shown in a honeycomb pattern in the illustrated embodiment, other configurations could also be used, for example, the fin plate could have a sinusoidal shape, with the peaks of the sinusoidal curve of one fin plate from one plate pair engaging the peak of the sinusoidal curve of a fin plate from an adjacent plate pair. Other multi-sided structures could also be formed by the fin plates.

Figure 14:
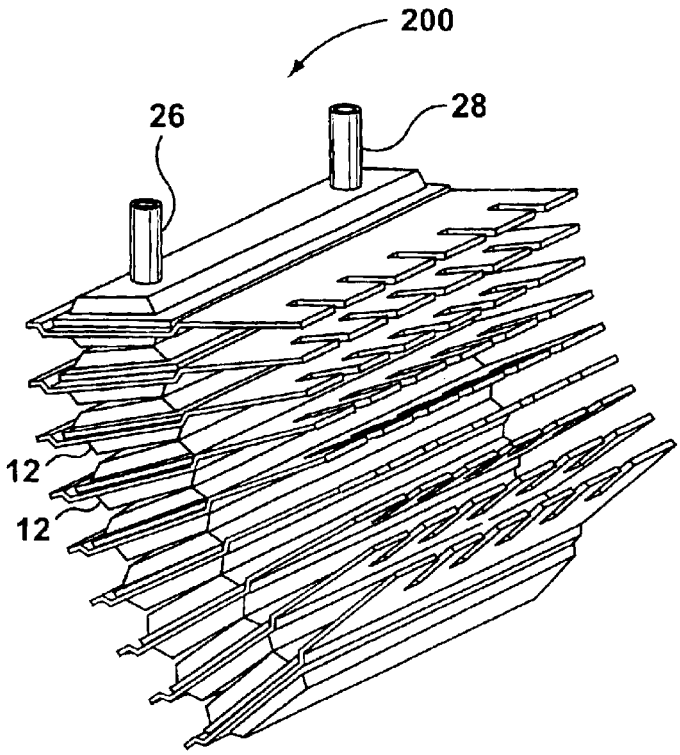
FIG. 14 is a perspective view of the heat exchanger of FIG. 13.
Figure 13:
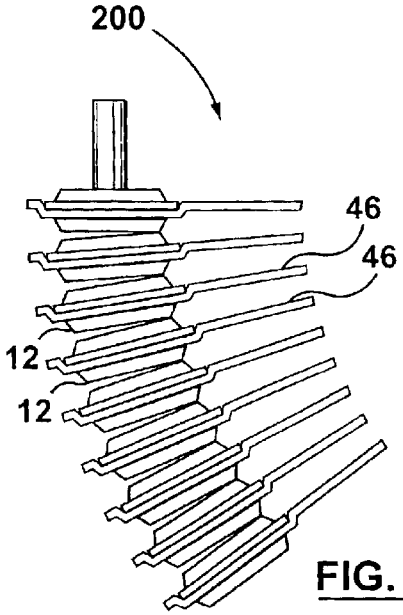
FIG. 13 is an end view of a heat exchanger according to a further embodiment of the invention.
Figure 15:
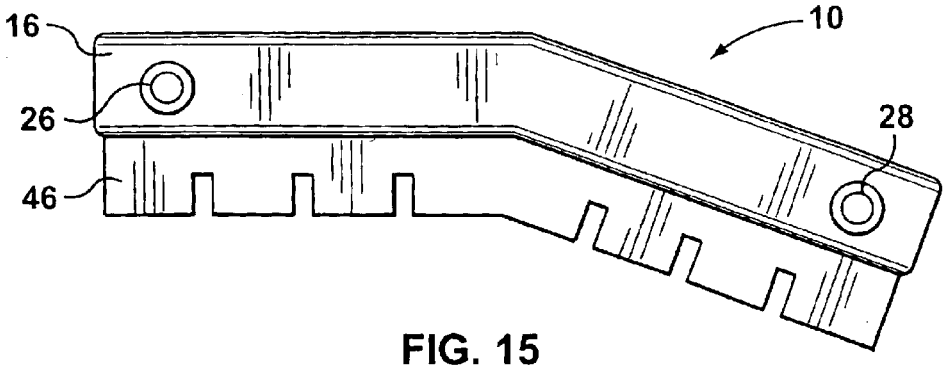
FIG. 15 is a side view of a heat exchanger according to yet another embodiment of the invention.

In some embodiments, the heat exchanger may be angled or curved to allow the heat exchanger to fit within a restricted space, or to improve heat exchanger efficiency. By way of example, FIGS. 13 and 14 show a heat exchanger 200, which is similar to heat exchanger 10 except that the heat exchanger 200 is arcuately bent about an axis parallel to the direction of internal fluid flow through the plate pairs 12. In one embodiment, heat exchanger 10 is bent after it has been brazed in order to form heat exchanger 200, which is curved to allow it to conform to the underbody of the snowmobile chassis or a vehicle underbody. In some embodiments, the heat exchanger may be angled or curved other than as shown in FIGS. 13 and 14, for example, the heat exchanger may be angled or curved along its longitudinal length, as shown in FIG. 15.

The plates used in the plate pairs of the present invention may be stamped from braze-clad roll formed aluminum or aluminum alloy. However other suitable metallic and non-metallic materials formed using various methods such as stamping, roll forming, molding, etc. could be used as desired for specific heat exchanger applications. In some embodiments, an epoxy or TEFLON™ or other coating may be provided on the heat exchanger to reduce the adherence of snow or ice or other debris to the outer surfaces of the heat exchanger. Similarly, corrosion inhibiting coatings could also be applied to the heat exchanger in some embodiments.

As will be apparent to those skilled in the art, many alterations and modifications are possible in the practice of this invention without departing from the spirit or scope thereof. Accordingly, the scope of the invention is to be construed in accordance with the substance defined by the following claims.

What is claimed is:

1. A surface cooled heat exchanger comprising:

a stack of elongate plate pairs, each plate pair including first and second plates having elongate central portions surrounded by sealably joined edge portions with a fluid passage defined between the central portions; each plate pair having spaced apart inlet and outlet openings that are connected together for the flow of fluid through the fluid passages; each plate pair having an exposed elongate fin plate extending peripherally outward from the joined edge portions along a length of the plate pair, said plate pairs including two end plate pairs and intermediate plate pairs arranged between the end plate pairs, each end plate pair abutting on one side thereof with a respective one of said intermediate plate pairs, the elongate central portion of the first plate of each intermediate plate pair abutting the elongate central portion of the second plate of an adjacent one of the plate pairs.

2. The heat exchanger of claim 1 wherein each fin plate has a varying profile along a length thereof.

3. The heat exchanger of claim 2 wherein the fin plates each define a plurality of spaced apart slots along a length thereof.

4. The heat exchanger of claim 3 wherein the slots are open ended at an outwardly extending end thereof.

5. The heat exchanger of claim 2 wherein the varying profile includes a plurality of louvered slots located along at least some of the fin plates.

6. The heat exchanger of claim 2 wherein the varying profile includes a plurality of expanded convolutions provided along at least some of the fin plates.

7. The heat exchanger of claim 2 wherein the fin plates of adjacent plate pairs come into intermittent contact with each other at a plurality of spaced apart locations along a length thereof.

8. The heat exchanger of claim 1 wherein the elongate central portions extend substantially from a first end to a second end of the plate pair and said elongate central portion of the first plate of each intermediate plate pair abuts the elongate central portion of the second plate of an adjacent plate pair substantially from the first end to the second end thereof.

9. The heat exchanger of claim 1 wherein the fin plate of each plate pair is formed integrally with only one of the first and second plates thereof.

10. The heat exchanger of claim 1 wherein the fin plate of each plate pair is formed from a plate portion formed integrally with the first plate and a further plate portion formed integrally with the second plate.

11. The heat exchanger of claim 1 wherein the first plate includes laterally extending flange around an outer edge of the edge portion thereof, the edge portion of the second plate being nested within the laterally extending flange, the fin plate extending from an edge of the laterally extending flange.

12. The heat exchanger of claim 1 wherein the heat exchanger is a snowmobile engine coolant cooler.

13. The heat exchanger of claim 1 wherein the elongate fin plates extend only from one elongate joined edge portion of the plate pairs.

14. A cooler for cooling snowmobile engine coolant comprising:

a stack of elongate plate pairs, each plate pair including first and second plates that are joined together to define an elongate sealed internal passage for the engine coolant having spaced apart inlet and outlet openings, said first and second plates having elongate central portions surrounded by sealably joined edge portions, said internal passage being formed between said central portions of each plate pair and extending substantially from a first end to a second end of the respective plate pair, said plate pairs including two end plate pairs and intermediate plate pairs arranged between the end plate pairs, each end plate pair abutting on one side thereof with a respective one of said intermediate plate pairs, the elongate central portion of the first plate of each intermediate plate pair abutting the elongate central portion of the second plate of an adjacent one of the plate pairs substantially from the first end to the second end thereof, each plate pair including an enlarged elongate, exposed fin plate portion located adjacent a substantial length of the internal passage for receiving materials flung by a drive track of he snowmobile; and mounting bracket means connected to the stack of plate pairs for securing the stack to the snowmobile.

15. The cooler of claim 14 wherein the mounting bracket means includes two L-brackets between which the stack of plate pairs is sandwiched.

16. The cooler of claim 14 wherein intermittent edge enhancement are provided along a length of the fin plate portion.

17. The cooler of claim 14 wherein the fin plates each define a plurality of spaced apart slots.

18. The cooler of claim 14 wherein a plurality of louvered slots are located along at least some of the fin plates.

19. The cooler of claim 14 wherein the stack is arcuately bent about axis thereof.

20. The cooler of claim 14 wherein the fin plates of adjacent plate pairs come into intermittent contact with each other at a plurality of spaced apart locations along a length thereof.

21. A cooler according to claim 14 wherein said elongate central portion of the first plate of each intermediate plate pair is parallel to and in substantial contact with the elongate central portion of the second plate of an adjacent one of the plate pairs.

22. A snowmobile having a chassis, a drive track, and a cooler according to claim 14 mounted between said chassis and said drive track, whereby during use of said snowmobile, engine coolant for said snowmobile can be cooled by one or more of the materials comprising slush, snow, ice, and water flung from said drive track.

23. The cooler of claim 19 wherein said axis is parallel to the direct on of internal fluid flow of said engine coolant through the internal passages during use of said cooler.

24. The cooler of claim 23 wherein said cooler is arcuately bent to conform to an underbody of said snowmobile.

* * * * *